US011717714B1

(12) United States Patent
Hong

(10) Patent No.: US 11,717,714 B1
(45) Date of Patent: Aug. 8, 2023

(54) WEIGHT-ADJUSTABLE DUMBBELL AND DUMBBELL ASSEMBLY

(71) Applicant: Guonian Hong, Zhejiang (CN)

(72) Inventor: Guonian Hong, Zhejiang (CN)

( * ) Notice: Subject to any disclaimer, the term of this patent is extended or adjusted under 35 U.S.C. 154(b) by 0 days.

(21) Appl. No.: 17/730,537

(22) Filed: Apr. 27, 2022

(30) Foreign Application Priority Data

Feb. 24, 2022 (CN) ..... 202220387031.7

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01)

(58) Field of Classification Search
CPC ..... A63B 21/00058; A63B 21/00061; A63B 21/00065; A63B 21/06; A63B 21/072–075
See application file for complete search history.

(56) References Cited

U.S. PATENT DOCUMENTS 8,529,415 B2 * 9/2013 Svenberg ..... A63B 21/075 482/106
8,715,143 B2 * 5/2014 Svenberg ..... A63B 21/072 482/106
10,583,318 B2 * 3/2020 Nalley ..... A63B 21/0726
11,167,167 B1 * 11/2021 Weng ..... A63B 21/0726
2009/0305852 A1 * 12/2009 Hoglund ..... A63B 21/0728 482/107
2010/0304940 A1 * 12/2010 Svenberg ..... A63B 21/0728 482/108

FOREIGN PATENT DOCUMENTS

CN 112587858 A * 4/2021
CN 114028764 A * 2/2022
TW M599676 U * 8/2020

* cited by examiner

*Primary Examiner* — Joshua Lee
*Assistant Examiner* — Kathleen M Fisk
(74) *Attorney, Agent, or Firm* — Cooper Legal Group, LLC

(57) ABSTRACT

Disclosed are a weight-adjustable dumbbell and a dumbbell assembly. The dumbbell assembly includes a grip rod assembly and a dumbbell plate, wherein the grip rod assembly includes an outer rotary rod and a telescopic rod, the telescopic rod is telescopically connected to the outer rotary rod, the telescopic rod movably penetrates through the dumbbell plate, and a limit structure is provided between adjacent dumbbell plates for restricting an axial movement between the adjacent dumbbell plates. A dumbbell assembly includes one or more weight-adjustable dumbbells as mentioned above and a dumbbell base.

3 Claims, 12 Drawing Sheets

WEIGHT-ADJUSTABLE DUMBBELL AND DUMBBELL ASSEMBLY

CROSS-REFERENCE TO RELATED APPLICATION

The present application claims the priority benefit of China application No. 202220387031.7, filed on Feb. 24, 2022. The entirety of China application No. 202220387031.7 is incorporated herein by reference and made a part of this specification.

TECHNICAL FIELD

The present application relates to the technical field of fitness equipment, and particularly to a weight-adjustable dumbbell and dumbbell assembly.

BACKGROUND

Dumbbell is a common fitness equipment. At present, there are dumbbells with a fixed weight or an adjustable weight on the market.

A user needs to use a set of weight-fixed dumbbells to meet the requirements on fitness. A weight-adjustable dumbbell generally includes a central shaft, a plurality of dumbbell plates that are successively connected to both ends of the central shaft and locking nuts that are respectively threaded to the both ends of the central shaft. In particular, the dumbbell plates on the central shaft are increased or decreased, the locking nuts screw for adjusting positions thereof on the central shaft, so that the dumbbell plates abut with each other, and thus adjusting the weight of the dumbbell.

In the above related technology, when the weight of the dumbbell needs to be changed, each time the locking nuts are required to be detached firstly, the dumbbell plates are installed and then the locking nuts are tightly screwed. Therefore, the installation process is complicated and time-consuming, which is inconvenient for adjusting the weight of the dumbbell.

SUMMARY

In order to adjust the weight of the dumbbell, the present application provides a weight-adjustable dumbbell and a dumbbell assembly.

In a first aspect, a weight-adjustable dumbbell according to the present application adopts the following technical solution.

A weight-adjustable dumbbell includes a grip rod assembly and a dumbbell plate, wherein the grip rod assembly comprises an outer rotary rod and a telescopic rod, the telescopic rod is telescopically connected to the outer rotary rod, the telescopic rod movably penetrates through the dumbbell plate, and a limit structure is provided between adjacent dumbbell plates for restricting an axial movement between the adjacent dumbbell plates.

In the above technical solution, rotating the outer rotary rod can drive the telescopic rod to lengthen or shorten, and the telescopic rod can be movably inserted into the position of the dumbbell plates to limit the movement of a plurality of dumbbell plates along radial direction at the same time. Further, by limiting the axial movement of adjacent dumbbells via the limit structure, a plurality of dumbbell plates can be lifted. Therefore, in the present application, only rotating the outer rotary rod can adjust the telescopic length of the telescopic rod, that is, different number dumbbell plates can be selected to facilitate adjusting weight of the dumbbell.

In particular, the limit structure comprises an inserting block and an inserting slot, and wherein an outer peripheral surface of the inserting block has a first guiding inclined surface, an inner peripheral surface of the inserting slot has a second guiding inclined surface, and the adjacent dumbbell plates are fitted with each other by means of the first guiding inclined surface and the second guiding inclined surface.

In the above technical solution, when the inserting block is inserted into the inserting slot, the first guiding inclined surface and the second guiding inclined surface are buckled with each other, so that the inserting block and the inserting slot cannot be detached in the axial direction of the dumbbell plate, thereby limiting the adjacent dumbbell plates to moving along the axial direction.

In particular, the inserting block is positioned within an outer peripheral surface of one side of the dumbbell plate.

In the above technical solution, the inserting block is positioned in outer peripheral surface of the dumbbell plate, so that the dumbbell plate can protect the inserting block. When the dumbbell is used, the probability of the inserting block colliding with objects can be reduced, so as to reduce the damage probability of dumbbell plates.

In particular, the dumbbell includes a plate body, a first weight block and a second weight block, the first weight block and the second weight block respectively connect to both sides of the plate body, an inserting slot is formed on the first weight block, and an inserting block is provided on the second weight block.

In the above technical solution, the dumbbell is divided into a plate body and a weight block, which are made of different materials, so that the cost can be saved and it is easy to be repaired and replaced if damaged in the later stage.

In particular, a positioning block is provided on one side of each of the first weight block and the second weight block, and a positioning slot is formed on each of both sides of the plate body for the positioning block to be inserted.

In the above technical solution, the positioning block is inserted into the positioning slot, then the mounted position of the first weight block and the second weight block on the plate body can be pre-positioned, so that the first weight block and the second weight block are conveniently connected to the plate body.

In particular, a positioning part is provided on the outer rotary rod, a spiral slot is formed on an outer peripheral surface of the telescopic rod, and the positioning part is inserted into the spiral slot.

In the above technical solution, the positioning part is inserted into the spiral slot, when the outer rotary rod is rotated, the positioning part can move along the spiral direction of the spiral slot and force the telescopic rod to lengthen or shorten along the axial direction.

In particular, a positioning part is provided at one end of the telescopic rod, a spiral slot is formed on an inner peripheral surface of the outer rotary rod, and the positioning part is inserted into the spiral slot.

In the above technical solution, the positioning part is inserted into spiral slot, when the outer rotary rod is rotated, the positioning part is moved along the spiral direction of the spiral slot and forces the telescopic rod to lengthen or shorten along the axial direction.

In particular, a convex limiting part is provided on an outer peripheral surface of the telescopic rod, a limiting slot is formed on the dumbbell plate, and the limiting part is inserted into the limiting slot.

In the above technical solution, the telescopic rod is penetrated through the dumbbell plate, and the limiting part is movably penetrated through the limiting slot at the same time. The matching of the limiting part and the limiting slot can limit the telescopic rod to rotating along the circumference direction, so that when the outer rotary rod is rotated to force the telescopic rod to move along the axial direction to improve the telescopic stability of the telescopic rod.

In particular, an inserting block is provided on one side of the dumbbell plate, and an inserting slot is provided on the other side for the inserting block to be inserted.

In the above technical solution, the matching of the inserting block and the inserting slot can limit the dumbbell plate to moving along the radial direction, so that the dumbbell plates can be limited to each other. When a plurality of the dumbbell plates is lifted, the plurality of the dumbbell plates can be stably connected to the telescopic rod.

In particular, the weight-adjustable dumbbell further includes a locking assembly, wherein the locking assembly comprises a locking plate and a locking head, and the locking plate and the outer rotary rod are able to be synchronously rotated.

In the above technical solution, when the locking head is unlocked the rotation of the locking plate, the locking plate and the outer rotary rod are rotated synchronously, so that the different number of the dumbbells can be selected. When the locking head is locked the rotation of the locking plate, the locking plate and the outer rotary rod cannot be rotated, so that the telescopic rod cannot be moved along the radial direction, the dumbbell plate is not easy to fall off after hanging to improve the security during exercising.

In particular, a plurality of locking slots are formed on the inner peripheral surface of the locking plate along a circumferential direction, the locking head is inserted to or staggered with the locking slot such that rotation of the locking plate is locked or unlocked.

In the above technical solution, the rotation of the outer rotary rod can drive the locking plate to rotate, and the locking head is inserted into the locking slot corresponding with the locking plate to lock the locking plate. When the locking head is detached from the locking slot corresponding to the locking plate, the locking plate is unlocked.

In particular, the locking assembly further includes an elastic element, which can force the locking head to have a movement trend to be inserted into the locking slot.

In the above technical solution, the elastic element forces the locking head to insert into the locking slot, when the dumbbell is lifted, the locking stability of the locking plate can be improved, so as to improve the security of the dumbbell during used.

In particular, the locking assembly further includes a locking housing rotationally connected with the locking plate, the locking housing is provided with an accommodating slot for sliding insertion of the locking head, one end of the elastic element abuts against the bottom of the accommodating slot, and the other end abuts against one end surface of the locking head.

In the above technical solution, the accommodating slot can provide a space for sliding of the locking head, so as to improve the moving stabilities of the locking head and the elastic element.

In a second aspect, the present application provides a dumbbell assembly, which adopts the following technical solution.

A dumbbell assembly includes one or more weight-adjustable dumbbells weight-adjustable dumbbell as mentioned above and a dumbbell base, a convex block is provided on the dumbbell base, the convex block abuts against a locking head, and the locking head is staggered with a locking slot.

In the above technical solution, when the dumbbell is positioned on the dumbbell base, the convex block is abutted against the locking head and detached the locking head from the locking slot, that is, the locking plate is unlocked, and the outer rotary rod is rotated to adjust the number of the dumbbell plates.

In summary, the present application has at least one of the following beneficial technical effects:

1. Only rotating the outer rotary rod can select the different number of dumbbell plates to facilitate the weight of the dumbbell;
2. The inserting block is positioned in the outer peripheral surface of the dumbbell plate to reduce the damage probability of the dumbbell plate; and
3. The matching of the inserting block, the inserting slot and the first guiding inclined surface and the second guiding inclined surface at both sides of the dumbbell plates can limit the radial movement of the adjacent dumbbell plates, and the other accessories is not need.

DESCRIPTION OF THE EMBODIMENTS

The present application will be described in detail below in combination with the drawings 1-17.

Figure 1:
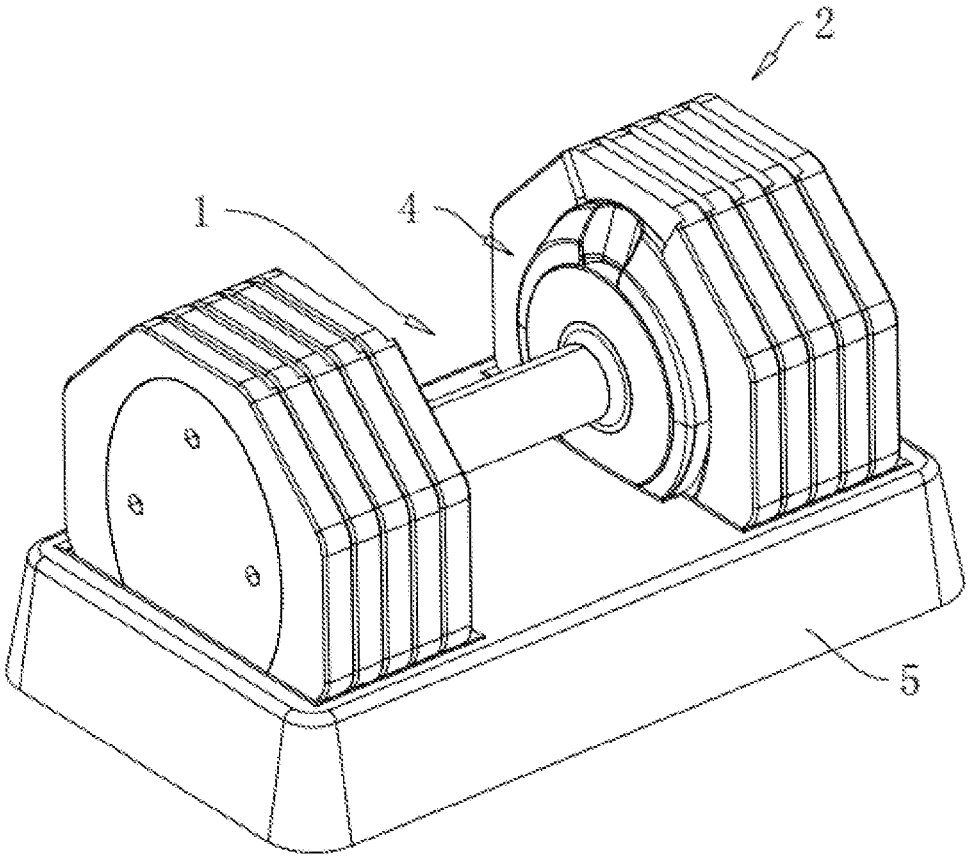
FIG. 1 is a schematic overall structural diagram of a dumbbell assembly according to an embodiment of the present application.

The present application provides a dumbbell assembly. Referring to FIG. 1, the dumbbell assembly includes a weight-adjustable dumbbell and a dumbbell base 5. The weight-adjustable dumbbell is placed on the dumbbell base 5.

Figure 2:
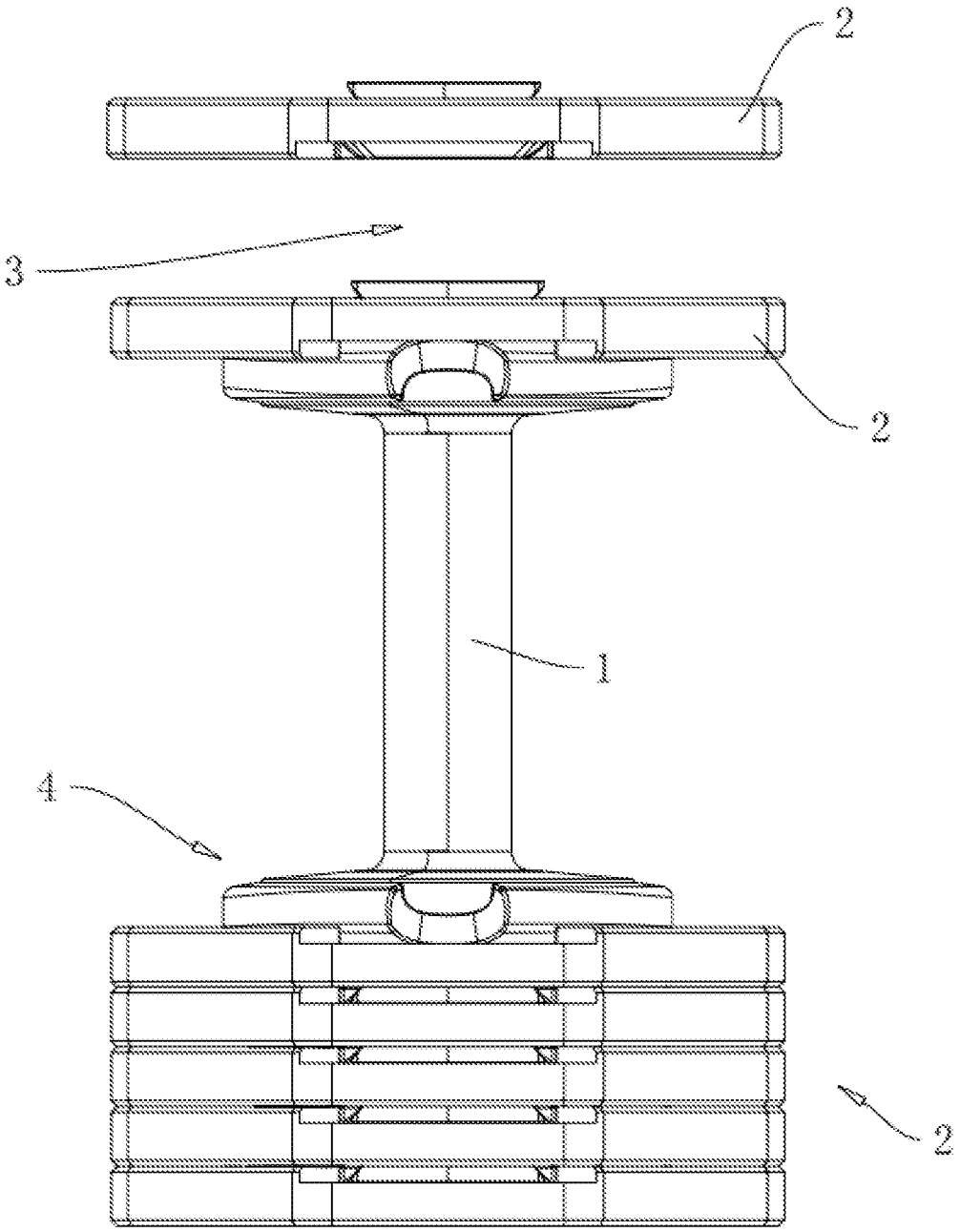
FIG. 2 is vertical view of a dumbbell assembly according to an embodiment of the present application.

Referring to FIGS. 1-2, the weight-adjustable dumbbell includes a grip rod assembly 1, a plurality of dumbbell plates 2 connecting to both ends of the grip rod assembly 1, a limit structure 3 is provided between every two adjacent dumbbell plates 2, and locking assemblies 4. The grip rod assembly 1 is rotated to limit a radial movement of the plurality of dumbbell plates. The limit structures 3 are used for limiting an axial movement of the plurality of dumbbell plates. The locking assemblies 4 are used for locking or unlocking rotation of the grip rod assembly 1. In this way, when the grip rod assembly 1 is lifted or put down, the selected dumbbell plates 2 can be lifted or put down stably.

Figure 3:
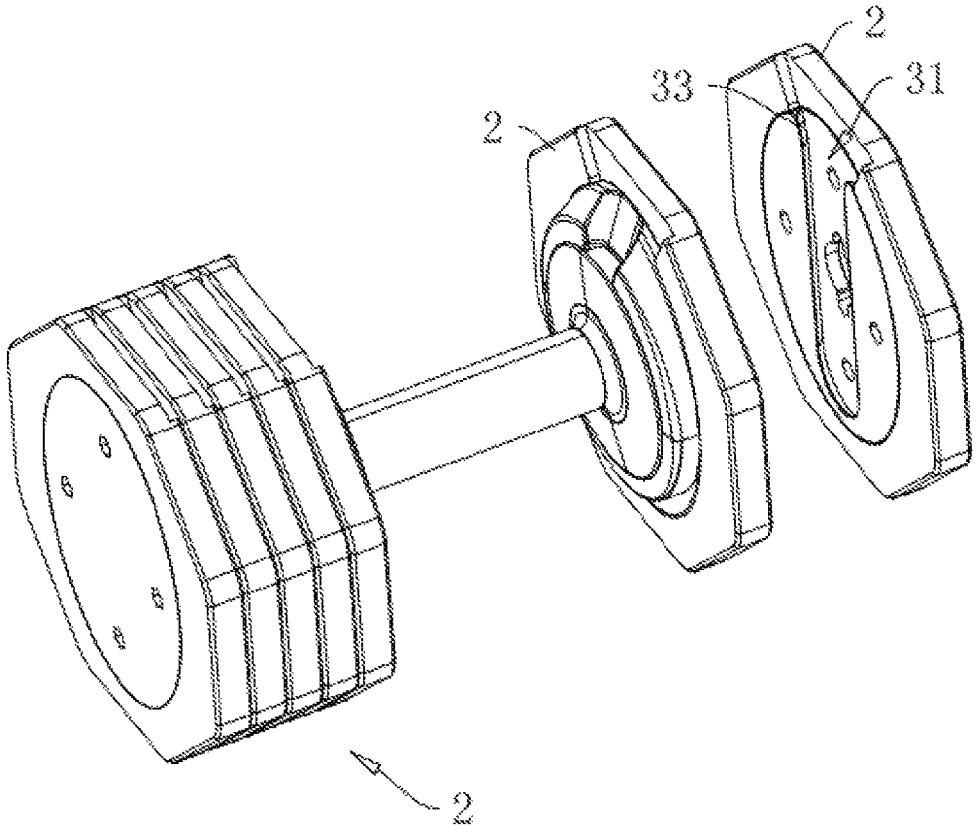
FIG. 3 is a schematic partial explosion diagram from a perspective of a dumbbell assembly according to an embodiment of the present application.
Figure 4:
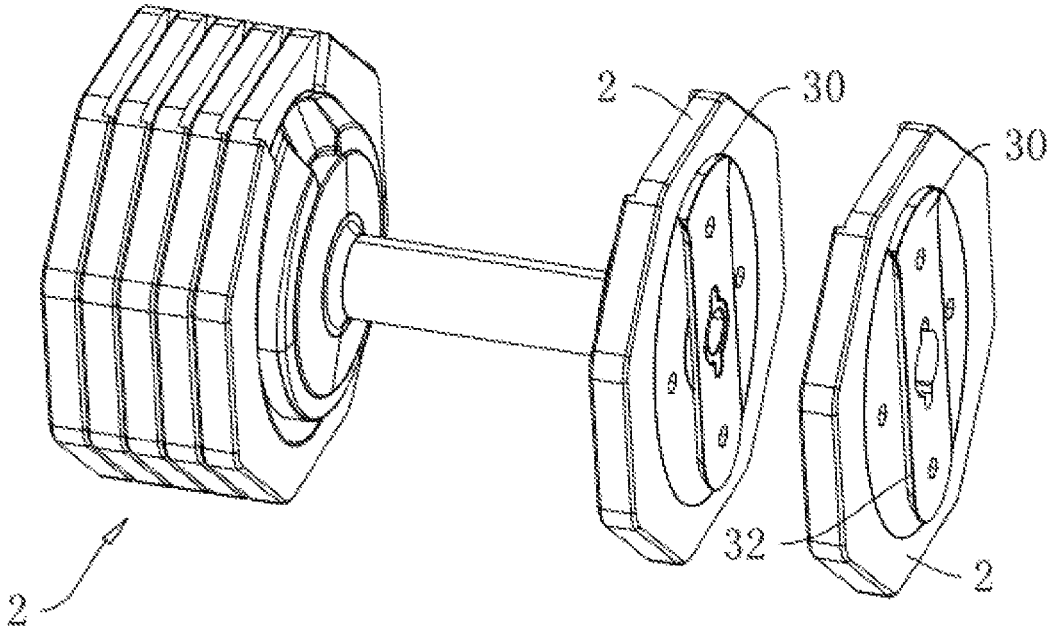
FIG. 4 is a schematic partial explosion diagram from another perspective of a dumbbell assembly according to an embodiment of the present application.

Referring to FIGS. 3-4, in an embodiment, the limit structure 3 includes an inserting block 30 protruding from one side of a dumbbell plate 2 and an inserting slot 31 formed on other side of the dumbbell plate 2, and an inserting block 30 is inserted into the inserting slot 31 for fitting with each other.

Figure 5:
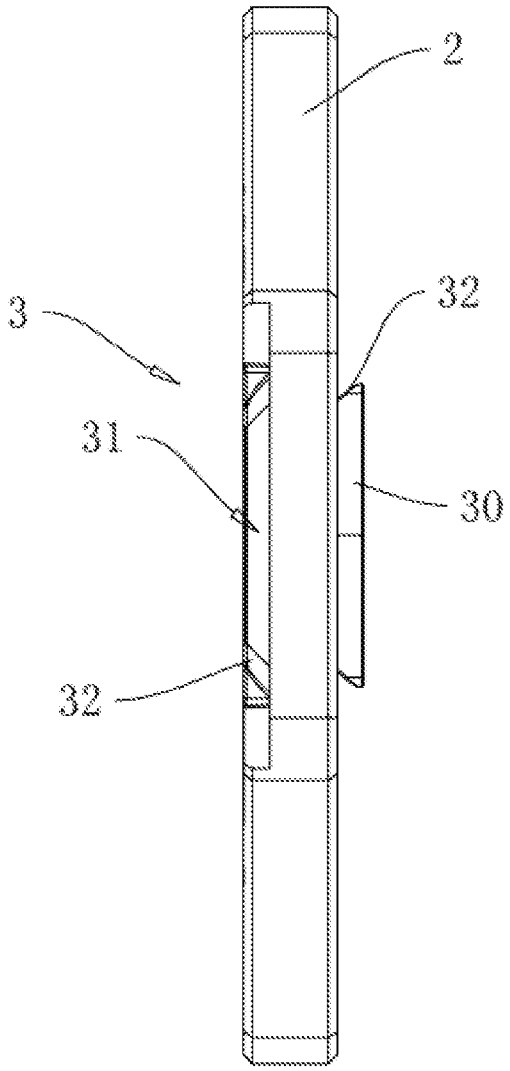
FIG. 5 is vertical view of a dumbbell plate according to an embodiment of the present application.

Referring to FIG. 5, an outer peripheral surface of the inserting block 30 has a first guiding inclined surface 32, and an inner peripheral surface of the inserting slot 31 has a second guiding inclined surface 33. When an inserting block 30 is inserted into an inserting slot 31, the first guiding inclined surface 32 fits to the second guiding inclined surface 33 to limit an axial moving between two adjacent dumbbell plates 2. In an embodiment, the inserting block 30 may be a T-shape block, dovetail block and the like.

In addition, it should be noted that, in order to facilitate picking and placing of the dumbbell plate 2, for one set of limit structures 3 in which an inserting block 30 and an inserting slot 31 are fitted with each other, in an assembly manner in which the inserting block 30 backs onto the center of the grip rod assembly 1, the inserting slot 31 is formed from top to bottom without penetrating at the bottom of the inserting slots 31, and in an assembly manner in which the inserting slot 31 backs onto the center of the grip rod assembly 1, the inserting slot 31 is formed from bottom to top without penetrating at the top of the inserting slots 31.

The inserting block 30 is arranged within in the outer peripheral surface of a side of the dumbbell plate 2. In this way, when the dumbbell plate 2 is contacted with the other objects, colliding of the inserting block 30 with the objects can be avoided, which can further reduce the possibility of the damage of dumbbell plate 2.

Figure 6:
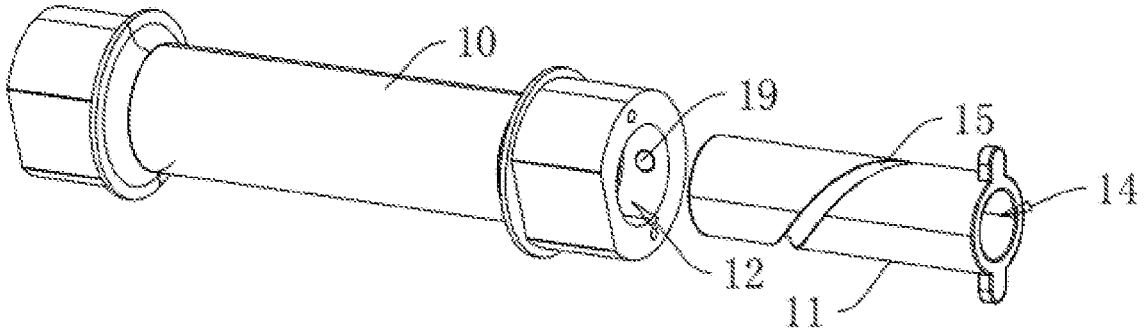
FIG. 6 is a schematic explosion diagram of a grip rod assembly according to an embodiment of the present application.

Referring to FIGS. 5-6, the grip rod assembly 1 includes an outer rotary rod 10 and two telescopic rods 11. The two telescopic rods 11 are telescopically connected to two ends of the outer rotary rod 10 respectively. That is, the telescopic rod 11 can penetrate through the dumbbell plate 2 along the axial direction of the outer rotary rod 10. The telescopic length of the telescopic rod 11 determines the number of dumbbell plates 2 to be assembled. The telescopic rod 11 may be movably penetrated in the outer rotary rod 10 or sleeved on the outside of outer rotary rod 10. In this embodiment of the present application, the telescopic rod 11 is movably penetrated in the outer rotary rod 10 as an example.

Figure 7:
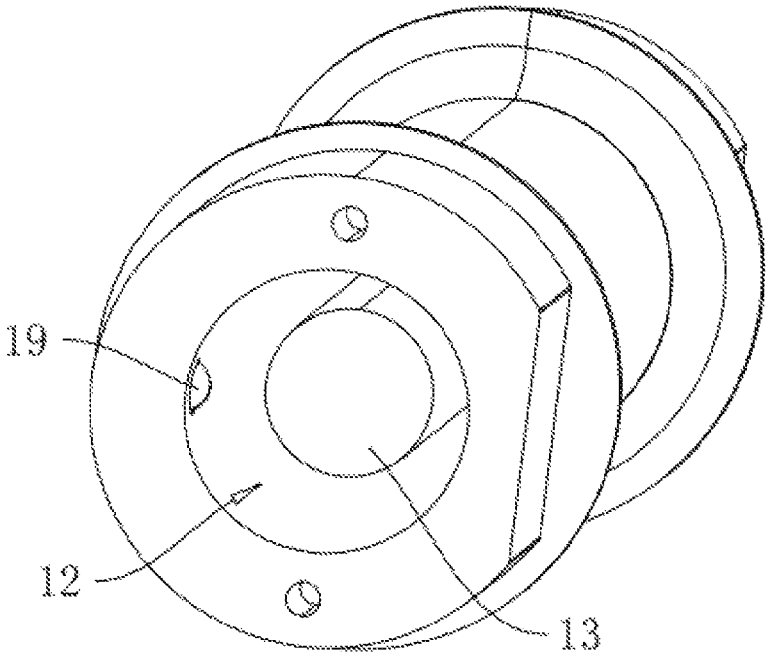
FIG. 7 is a schematic structural diagram of an outer rotary rod according to an embodiment of the present application.

Referring to FIGS. 6-7, telescopic holes 12 are respectively formed at the two ends of the outer rotary rod 10 for the movable penetration of the telescopic rod 11. A guide column 13 is provided in the telescopic hole 12 of the outer rotary rod 10, and a guide hole 14 is provided at one end of the telescopic rod 11 for the movable penetration of the guide column 13. In an embodiment, a positioning part 19 is provided at each of both ends of the outer rotary rod 10, a spiral slot 15 is formed on an outer peripheral surface of the telescopic rod 11, and one end of the positioning part 19 is able to extend into the spiral slot 15. When the outer rotary rod 10 is rotated, the positioning part 19 may move along the spiral slot 15, and the telescopic rod 11 may extend-retract to penetrate through different number of the dumbbell plates 2 as the rotation of the outer rotary rod 10.

Referring to FIG. 6, in the present application, the positioning part 19 is preferably a ball plunger. The column potion of the ball plunger is threadedly connected to the end of the outer rotary rod 10 and penetrates into the outer rotary rod 10. The ball end of the ball plunger is positioned in the outer rotary rod 10 and extends into the spiral slot 15. In an embodiment, the spiral slot 15 is formed on the inner peripheral surface of the outer rotary rod 10, and the positioning part 19 is arranged on each end of the telescopic rod 11.

Figure 8:
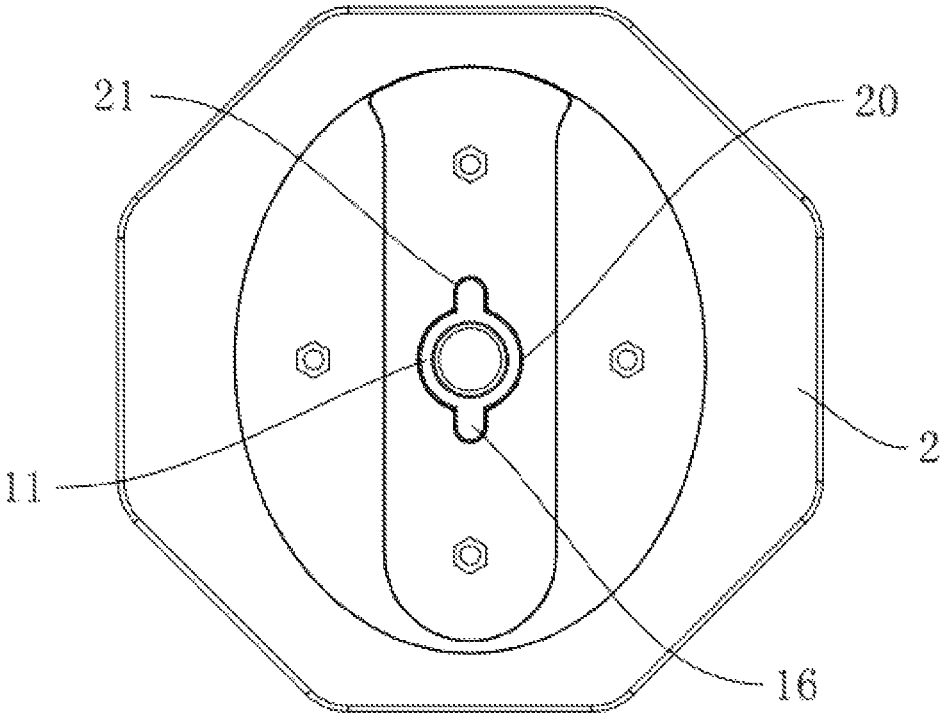
FIG. 8 is a schematic diagram illustrating matching of a telescopic rod with a dumbbell plate according to an embodiment of the present application.

Referring to FIG. 8, the telescopic rod 11 movably penetrates through the dumbbell plates 2. A through hole 20 is formed on the dumbbell plate 2, which penetrates through both sides of the dumbbell plate 2, and the telescopic rod is able to pass through the through hole 20. Through holes 20 of a plurality of the dumbbell plates 2 are coaxial. A limiting part 16 is protruded on the outer peripheral surface on one end of the telescopic rod 11, and a limiting hole 21 is formed on the dumbbell plate 2 for inserting of the limiting part 16, and the limiting hole 21 is communicated with the through hole 20. Similarly, the limiting holes 21 of a plurality of the dumbbell plates 2 are coaxial. When the telescopic rod 11 passes through the through hole 20, the limiting part 16 is inserted into the limiting hole 21.

Referring to FIGS. 6 and 8, the through hole 20 can restrict a radial moving of the telescopic rod 11. The circumferential rotation of the telescopic rod 11 is restricted by the limiting hole 21 in conjunction with the limiting part 16. Therefore, when the outer rotary rod 10 is rotated, the positioning part 19 also rotates as the outer rotary rod 10, and when the positioning part 19 moves along the spiral slot 15, the telescopic rod 11 moves along the axial direction. By rotating the outer rotary rod 10 clockwise or counterclockwise, the telescopic rod 11 is able to extend out or retract into the outer rotary rod 10. The telescopic length of the telescopic rod 11 can be controlled by the rotating angle of the outer rotary rod 10. Correspondingly, the limiting part 16 is inserted into a limiting hole 21 of a dumbbell plate 2 to be selected, so that when the outer rotary rod 10 is lifted, the corresponding number of the dumbbell plates 2 can be lifted.

Figure 9:
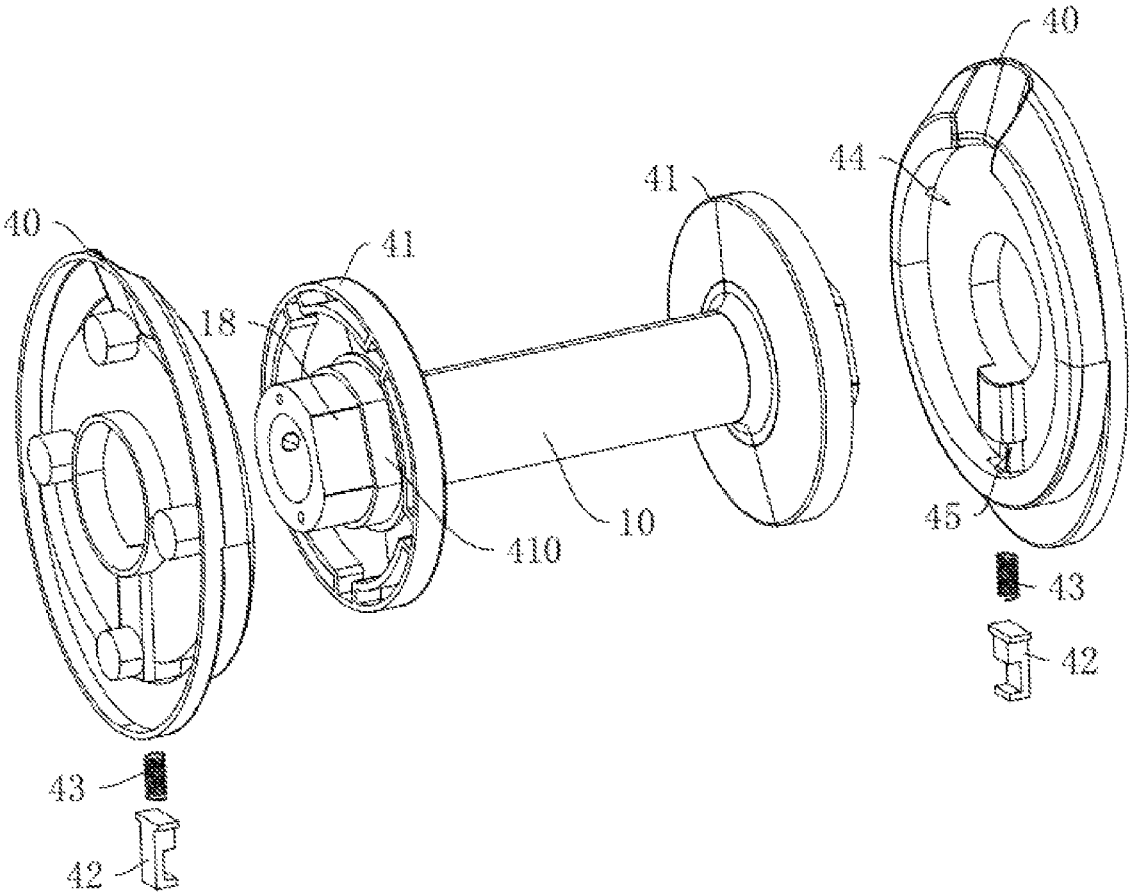
FIG. 9 is a schematic explosion diagram of a locking assembly according to an embodiment of the present application.
Figure 10:
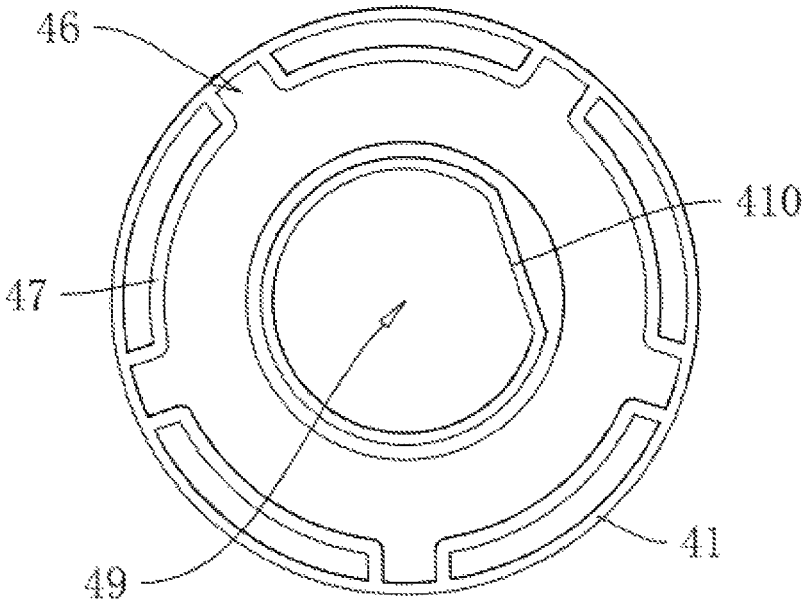
FIG. 10 is a schematic structural diagram of a locking plate according to an embodiment of the present application.

Referring to FIGS. 9-10, the locking assembly 4 includes a locking housing 40, a locking plate 41, a locking head 42 and an elastic element 43. In particular, the locking housing is always in a relative fixed state, the locking plate 41 rotatably connects to the locking housing 40, and the locking plate 41 is key-jointed with one end of the outer rotary rod 10 and is able to rotate synchronously with the outer rotary rod 10. In particular, a key plane 18 is provided on the outer peripheral surface of one end of the outer rotary rod 10. A central hole 49 is formed in the central part of the locking plate 41, through which one end of the outer rotary rod 10 is able to pass. A key convex block 410 is formed on an inner wall of the central hole 49 of the locking plate 41. When the outer rotary rod 10 passes through the central hole 49, the key plane and the key convex block 410 18 together forms a key fit.

An accommodating slot 44 is formed on one side of the locking housing 40, and the locking plate 41 is positioned in the accommodating slot 44. The locking plate 41 is able to rotate in the accommodating slot 44. A sliding slot 45 is formed at a lower end of the locking housing 40 for sliding of locking head 42, which communicates with the accommodating slot 44.

Referring to FIG. 10, a plurality of convex locking slots 46 are formed on an end surface of the locking plate 41 facing to the locking housing 40 at intervals along the circumferential direction. Specifically, a plurality of locking blocks 47 are formed on the end surface of the locking plate 41 facing to the locking housing 40 at intervals along the circumferential direction, and a locking slot 46 is formed between two adjacent locking blocks 47. In an embodiment of the present application, five locking blocks 47 is provided, and five locking slots 46 are correspondingly formed, so as to lock the five dumbbell plates 2.

Figure 11:
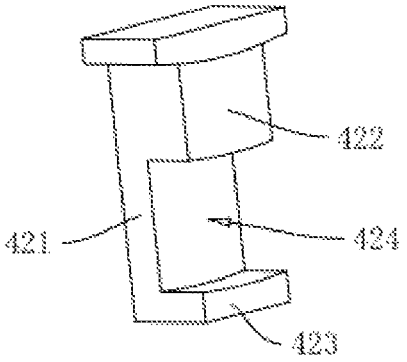
FIG. 11 is a schematic structural diagram of a locking head according to an embodiment of the present application.

Referring to FIGS. 10-11, the locking head 42 includes a connecting part 421, an abutting part 422 integrally formed at one end of the connecting part 421, and a trigger part 423 integrally formed at the other end of the connecting part 421. Depending on a fitting of the abutting part 422 with the locking slot 46, the locking plate 41 may be in a locking state or an unlocking state. In particular, the lower end of the abutting part 422 is able to be inserted into the locking slot 46, so as to restrict the rotation of the locking plate 41, so that the locking plate 41 is in a locking state. An avoidance slot 424 is formed between the abutting part 422 and the trigger part 423. In a state that the abutting part 422 is staggered with the locking slot 46, the outside peripheral portion of the locking plate 41 and the locking block 47 are able to pass through the avoidance slot 424, so that the locking plate 41 is able to rotate to unlock the locking plate 41.

In an embodiment of the present application, the elastic element 43 is preferably a compression spring. In order to improve the locking stability of the locking plate 41, one end of the elastic element 43 abuts against the bottom of the sliding slot 45, and the other end abuts against the top end of the abutting part 422, so that the abutting part 422 is always forced to have a tendency to insert into the locking slot 46.

Figure 12:
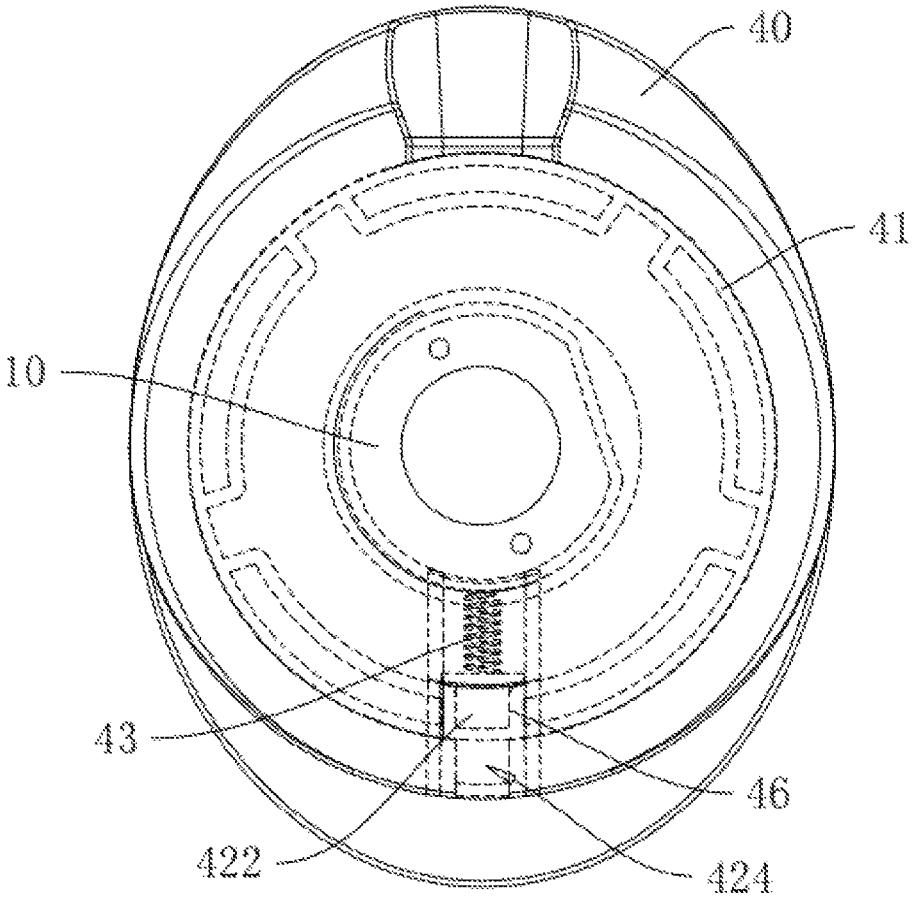
FIG. 12 is a schematic structural diagram of a locking plate in a locking state according to an embodiment of the present application.
Figure 13:
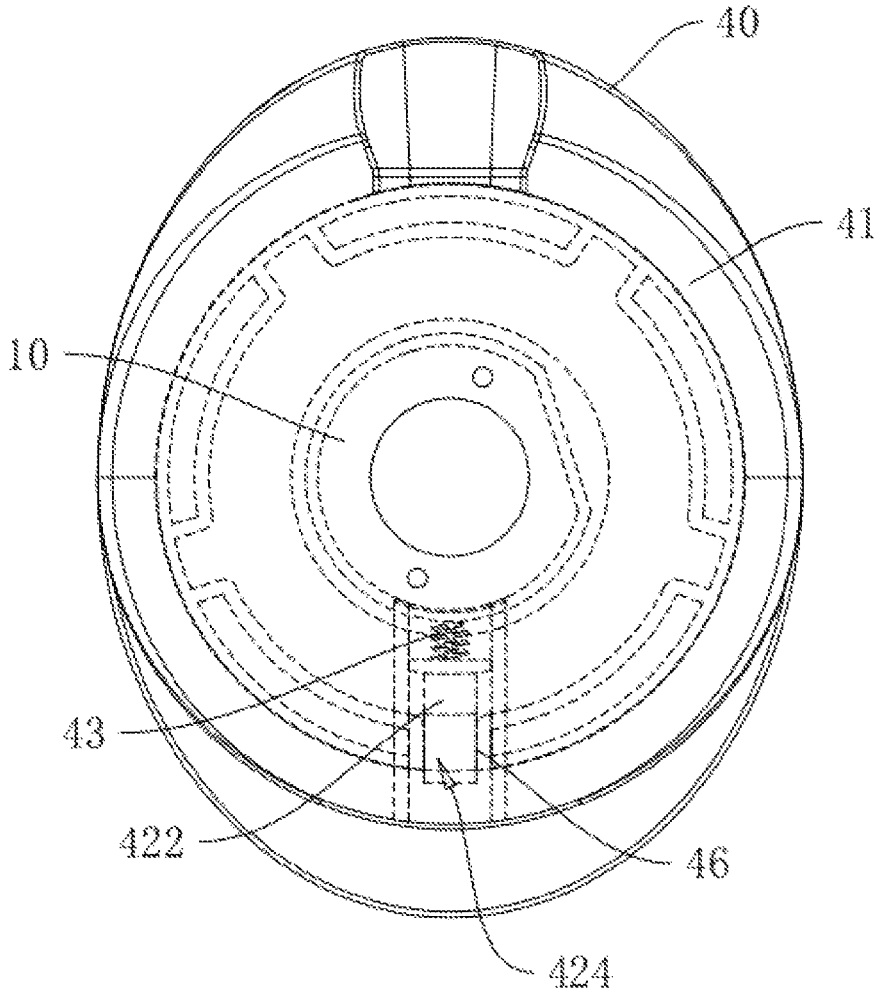
FIG. 13 is a schematic structural diagram of a locking plate in an unlocking state according to an embodiment of the present application.

Referring to FIGS. 12-13, when the abutting part 422 is inserted into the locking slot 46, the elastic element 43 is reset, and the locking plate 41 is locked and cannot be rotated. That is, the locking plate 41 is in a locking state to restrict the rotation of the outer rotary rod 10.

When the abutting part 422 is staggered with the locking slot 46, the elastic element 43 is compressed, the outer peripheral portion of the locking plate 41 and the locking block 47 are rotated in the avoidance slot 424, and the locking plate 41 is unlocked to rotate again. That is, the locking plate 41 is in an unlocking state, in which the outer rotary rod 10 is able to rotate.

Figure 14:
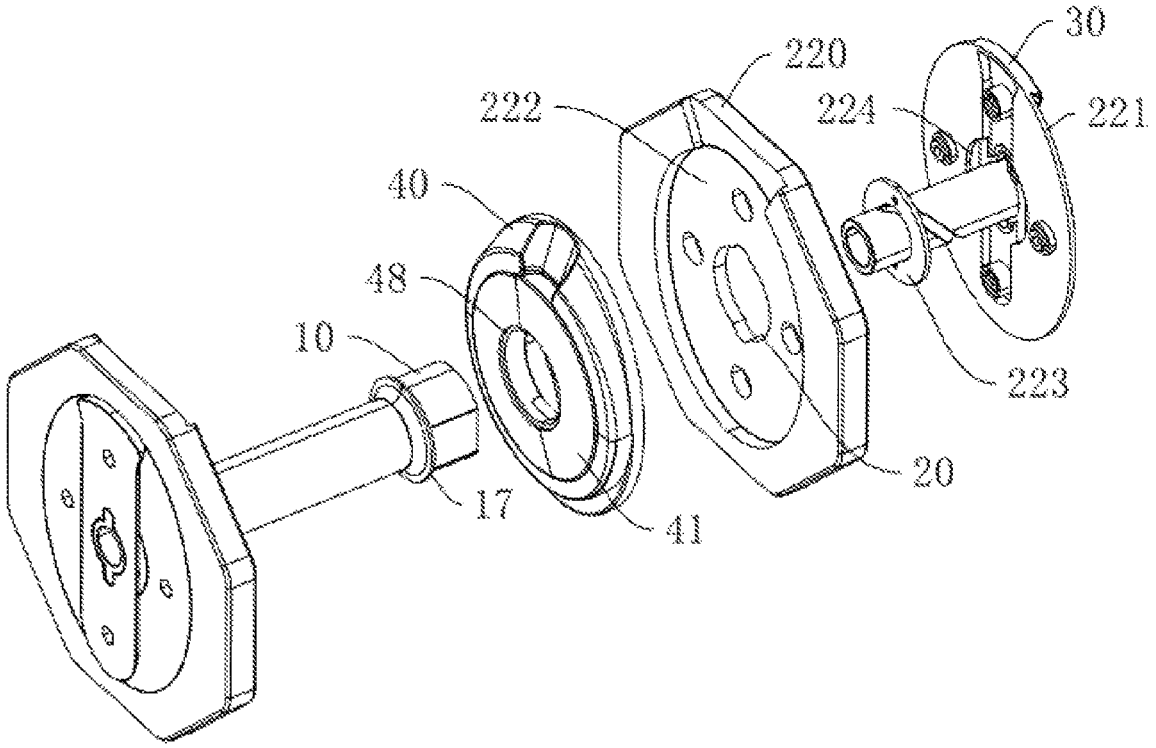
FIG. 14 is a schematic explosion diagram of a first plate according to an embodiment of the present application.
Figure 15:
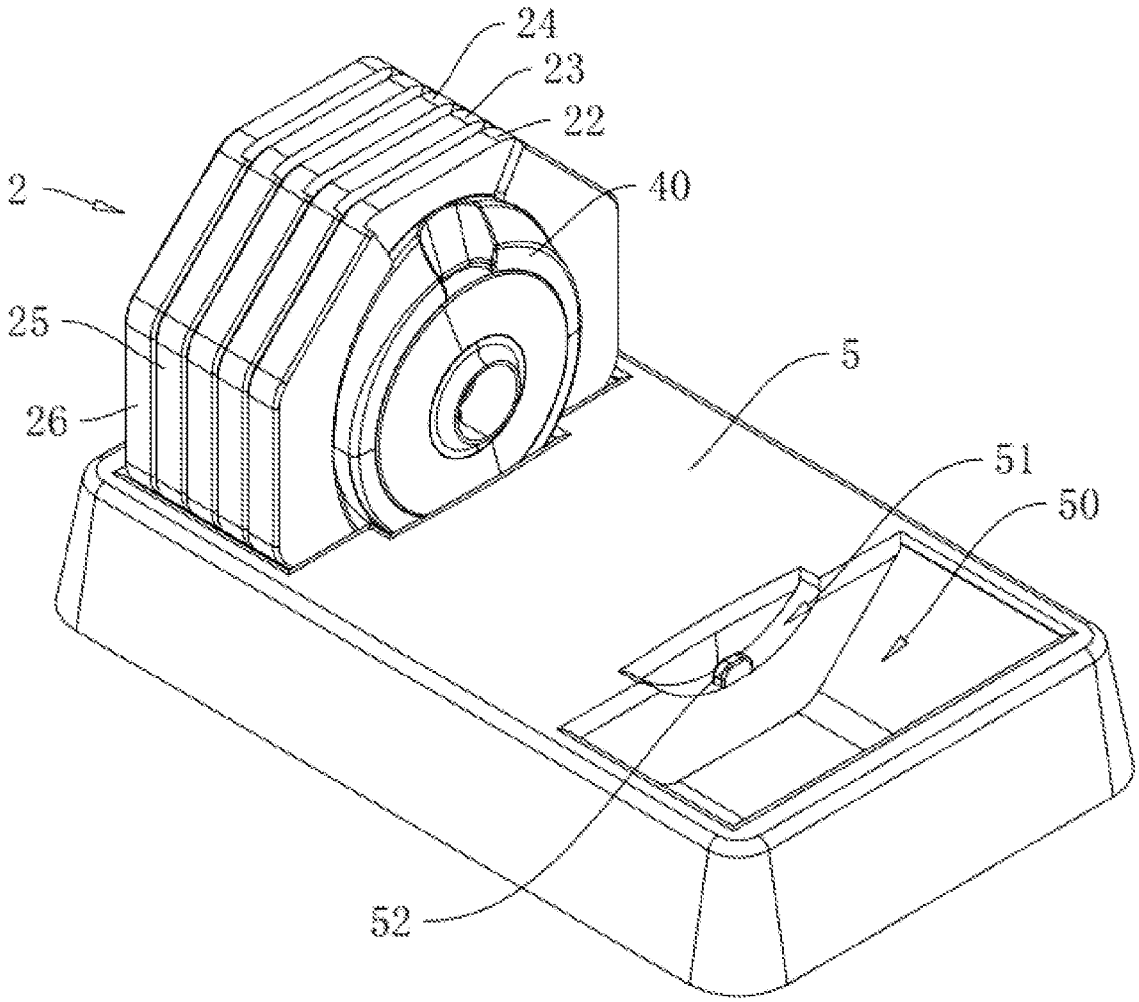
FIG. 15 is a schematic diagram illustrating matching of a dumbbell plate with a dumbbell base according to an embodiment of the present application.

Referring to FIGS. 14-15, in an embodiment in the present application, five dumbbell plates 2 as a group are provided, which are named as a first plate 22, a second plate 23, a third plate 24, a fourth plate 25 and a fifth plate 26 along a direction from top to the both ends of the outer rotary rod 10, that is, the first plate 22 is the innermost dumbbell plate and is fixed with the locking housing 40.

The first plate 22 includes a first plate body 220 and a first weight block 221. The first weight block 221 is connected to a side of the first plate body 220 away from the outer rotary rod 10. A first inserting slot 222 for insertion of the locking housing 40 is formed on a side of the first plate body close to the first weight block 221. A through hole 20 and a limiting hole 21 are provided on the first plate body 220 and the first weight block 221.

Referring to FIG. 14, a limiting ring slot 48 is formed on one side of the locking plate 41, and correspondingly, a limiting flange 17 is formed at one end of the outer rotary rod 10. When one end of the outer rotary rod 10 is key jointed to the locking plate 41, the limiting flange 17 is inserted into the limiting ring slot 48, so that the locking housing 40 is restricted to move toward the outer rotary rod 10.

A fixing piece 223 is provided between the first plate body 220 and the first weight block 221. The fixing piece 223 is movably sleeved on the telescopic rod 11. A positioning slot 224 for accommodating the fixing piece 223 is formed on one side of the first weight block 221, and an inserting block 30 is provided on the other side of the first weight block 221.

Referring to FIG. 14, the diameter of the fixing piece 223 is larger than the hole diameter of the through hole 20. Therefore, the fixing piece 223 cannot pass through the through hole. The fixing piece 223 is fixed with one end surface of the outer rotary rod 10 via a screw, so that the first plate body is fixed between the fixing piece 223 and the locking housing 40. Specifically, after passing through the fixing piece 223, the screw is threadedly connected to one end surface of the outer rotary rod 10 with passing through the limiting hole 21. Further, the first plate body 220 is connected to the first weight block 221 by a fastener such as screw or bolt, so that the first plate 22 is fixed with the locking housing 40.

Referring to FIG. 15, each of the second plate 23, the third plate 24, the fourth plate 25 and the fifth plate 26 may be integrally casted or assembled separately. In order to facilitate manufacture, in the present application, each of the second plate 23, the third plate 24, the fourth plate 25 and the fifth plate 26 is assembled separately. In particular, the second plate 23, the third plate 24, the fourth plate 25 have the same structure, and the structure of the second plate 23 will be described as an example as following.

Figure 16:
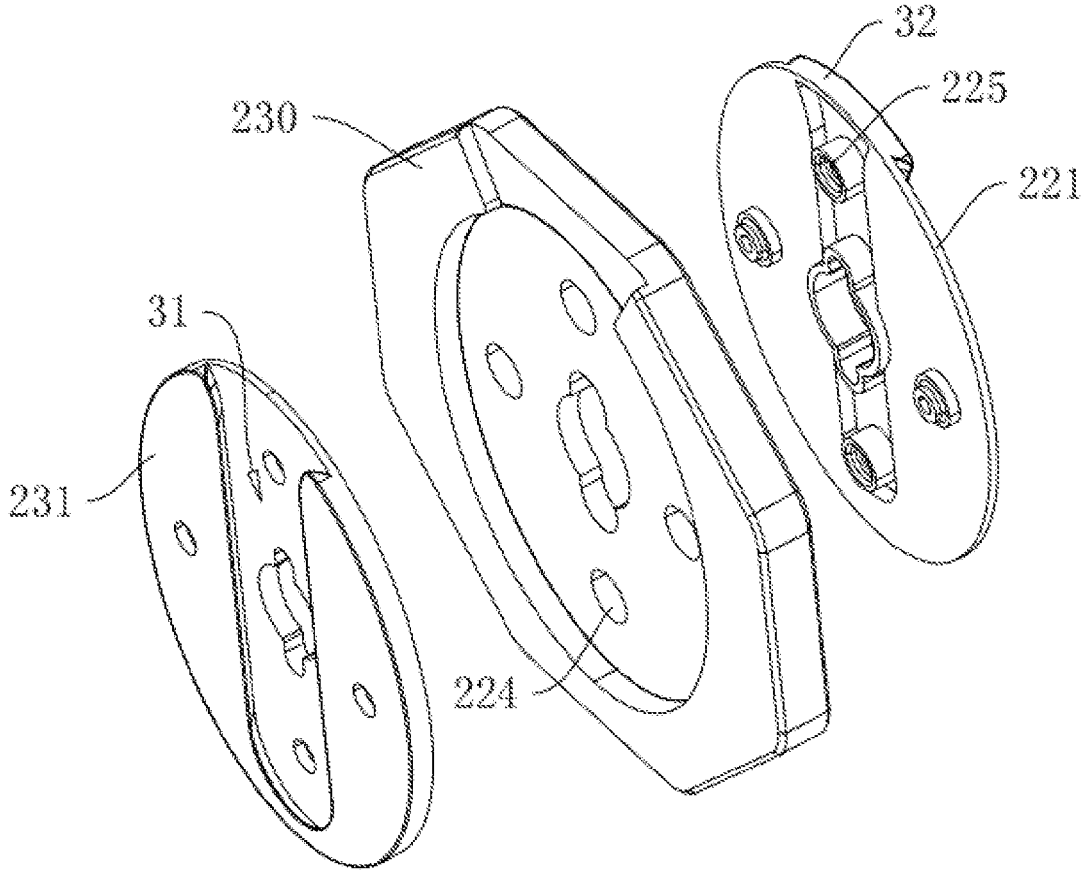
FIG. 16 is a schematic explosion diagram of a second plate according to an embodiment of the present application.

Referring to FIG. 16, the second plate 23 includes a second plate body 230, a first weight block 221 and a second weight block 231. The first weight block 221 is connected to one side of the second plate body 230 close to the outer rotary rod 10, and the second weight block 231 is connected to one side of the second plate body 230 away from the outer rotary rod 10. An inserting slot 31 is formed on the first second weight block 231 along the axial direction from top to bottom without penetrating at the bottom. An inserting block 30 is integrally provided on the outer side surface of the first weight block 221. When the first plate 22 is connected to the second plate 23, the inserting block 30 of the first plate 22 is inserted into the inserting slot 31 of the second plate 23. The second plate 23, the third plate 24, the fourth plate 25 and the fifth plate 26 are connected in a manner same as the connecting of the first plate 22 with the second plate 23, which are connected by a inserting slot 31 and an inserting block 30.

Referring to FIG. 16, the first weight block 221 and the second weight block 231 is connected to the second plate body 230 by a fastener such as screw or bolt. In order to facilitate connecting by the fastener, a positioning block 225 is provided on one side of each of the first weight block 221 and the second weight block 231, and a positioning slot 224 is formed on both sides of the second plate body 230. The positioning block 225 is inserted into the positioning slot 224, which is used as a pre-position for connecting of fasteners.

Referring to FIG. 15, since the fifth plate 26 is as the outermost dumbbell plate 2, an inserting block 30 is not provided on one side of the fifth plate 26 away from the outer rotary rod 10. In an embodiment, an inserting block 30 is provided on one side of the fifth plate 26 such that the fifth plate 26 can be used as a replacing plate.

Figure 17:
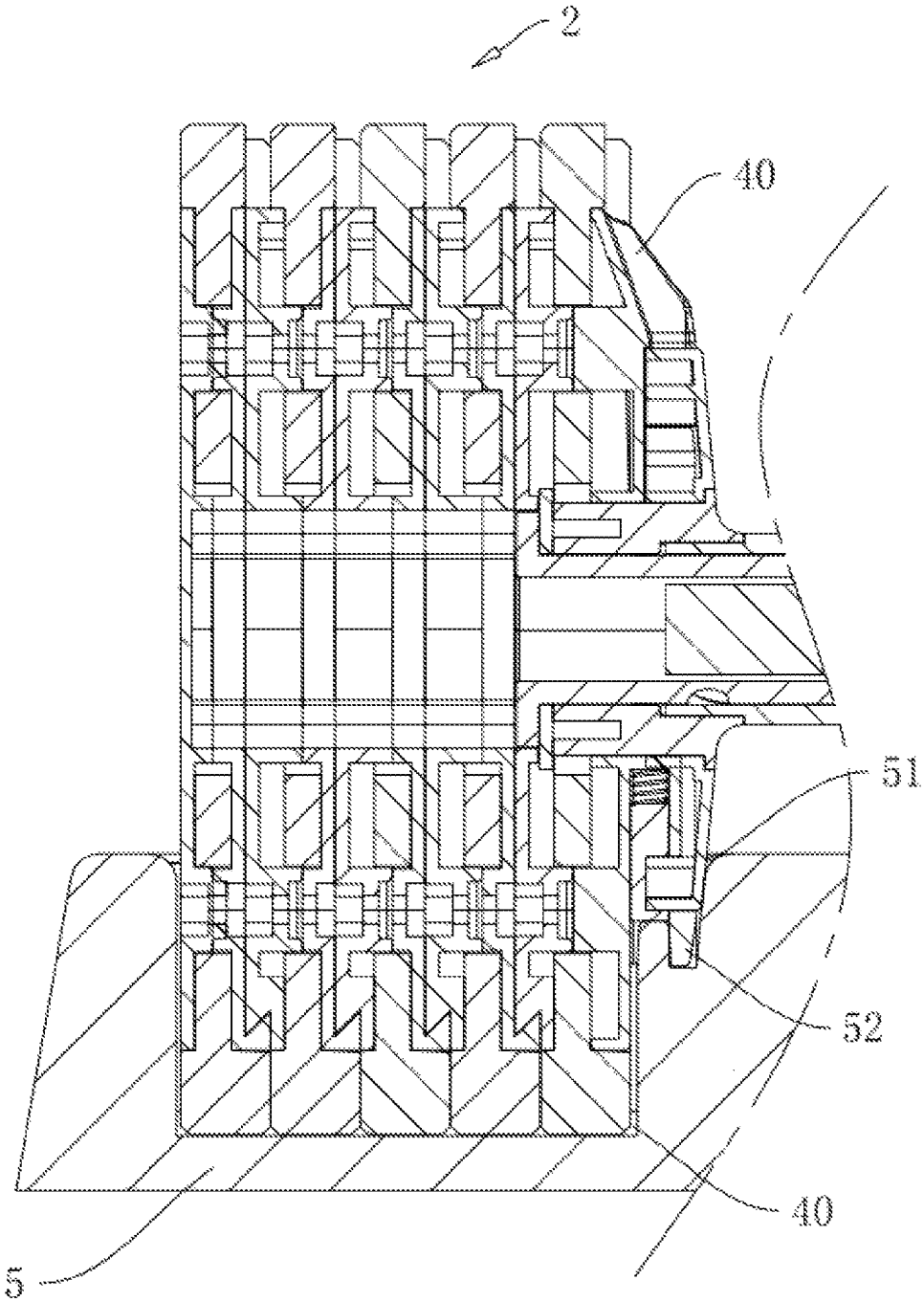
FIG. 17 is a partial structural sectional view of a dumbbell assembly according to an embodiment of the present application.

Referring to FIGS. 15 and 17, the dumbbell base 5 is provided with a placing slot 50 for the dumbbell plate 2 to be placed and a mounting slot 51 for a locking housing 40 to be inserted. A convex block 52 is provided in the mounting slot 51, which corresponds to the sliding slot 45. When the dumbbell is placed on the dumbbell base 5, the convex block 52 abuts against the trigger part 423, so that the elastic element 43 is compressed, and the locking plate 41 is always in an unlocking state.

The implementation principle of the weight-adjustable dumbbell and dumbbell assembly in the present application is as follows: when the dumbbell is placed on the dumbbell base 5, the locking plate 41 is unlock, then the extension length of the telescopic rod 11 can be adjusted by rotating the outer rotary rod 10, so that the telescopic rod 11 can be inserted into the corresponding dumbbell plate 2, and adjacent dumbbell plates 2 can be connected by the limit structure 3.

After the dumbbell plate 2 is selected and lifted, the locking plate 41 is in a locking state, the outer rotary rod 10 cannot be rotated, and the dumbbell plate 2 cannot be detached, so that the safety of the users can be ensured.

The above are the preferred embodiments of the present application, which are not intended to limit the protection scope of the present application. Therefore, all equivalent changes made according to the structure, shape and principle of the present application should be covered within the protection scope of the present application.

LIST OF REFERENCES

1. Grip rod assembly; 10. Outer rotary rod; 11. Telescopic rod; 12. Telescopic hole; 13. Guide column; 14. Guide hole; 15. Spiral slot; 16. Limiting part; 17. Limiting flange; 18. Key plane; 19. Positioning part;

2. Dumbbell plate; 20. Through hole; 21. Limiting hole; 22. First plate; 23. Second plate; 24. Third plate; 25. Forth plate; 26. Fifth plate; 220. First plate body; 221. First weight block; 222. First inserting slot; 223. Fixing piece; 224. Positioning slot; 225. Positioning block; 231. Second weight block;

3. Limiting structure; 30. Inserting block; 31. Inserting slot; 32. First guiding inclined surface; 33. Second guiding inclined surface;

4. Locking assembly; 40. Locking housing; 41. Locking plate; 42. Locking head; 43. Elastic element; 44. Accommodating slot; 45. Sliding slot; 46. Locking slot; 47. Locking block; 48. Limiting ring slot; 49. Central hole; 421. Connecting part; 422. Abutting part; 423. Trigger part; 424. Avoidance slot; 410. Key convex block; and 5. Dumbbell base; 50. Placing slot; 51. Mounting slot; 52. Convex block.

What is claimed is:

1. A weight-adjustable dumbbell, comprising: a grip rod assembly and a dumbbell plate, wherein the grip rod assembly comprises an outer rotary rod and two telescopic rods, the two telescopic rods are telescopically connected to two ends of the outer rotary rod respectively, each of the two telescopic rods is configured to movably penetrate through the dumbbell plate, and a limit structure is provided between the dumbbell plate and an adjacent dumbbell plate for restricting an axial movement between the dumbbell plate and the adjacent dumbbell plate;

the dumbbell plate comprises an inserting block and the adjacent dumbbell plate comprises an inserting slot;

the limit structure comprises the inserting block of the dumbbell plate and the inserting slot of the adjacent dumbbell plate, and an outer peripheral surface of the inserting block has a first guiding inclined surface, an inner peripheral surface of the inserting slot has a second guiding inclined surface, and the dumbbell plate and the adjacent dumbbell plate are fitted with each other by the first guiding inclined surface and the second guiding inclined surface;

the dumbbell plate comprises a plate body, a first weight block and a second weight block, the first weight block and the second weight block respectively connect to central portions of two opposing sides of the plate body at two axial ends of a horizontal axis of the plate body and are coaxial with the plate body; a positioning block extending towards a horizontal axial direction of the plate body is provided on one side of each of the first weight block and the second weight block, and a positioning slot is defined on each of the two opposing sides of the plate body for the respective positioning blocks to be inserted along the horizontal axial direction of the plate body; and the dumbbell plate further comprises an inserting slot defined on the second weight block, the inserting block of the dumbbell plate is provided on the first weight block, and the horizontal axis of the plate body passes through the inserting slot and the inserting block of the dumbbell plate;

telescopic holes are respectively formed at the two ends of the outer rotary rod for the movable penetration of the two telescopic rods, and a guide column is provided in each of the telescopic holes of the outer rotary rod, and a guide hole is provided at one end of each of the two telescopic rods for movable penetration of one of the guide columns; a positioning part is provided at each of the two ends of the outer rotary rod, a spiral slot is formed on an outer peripheral surface of each of the two telescopic rods, and one end of each of the positioning parts is configured to extend into a respective one of the spiral slots;

the weight-adjustable dumbbell further comprises a locking assembly, the locking assembly comprises a locking plate and a locking head, and the locking plate and the outer rotary rod are configured to be synchronously rotated;

a plurality of locking slots are formed on an inner peripheral surface of the locking plate along a circumferential direction, the locking head is configured to be inserted into or staggered with the locking slots such that rotation of the locking plate is locked or unlocked;

the locking assembly further comprises an elastic element, which is configured to force the locking head to have a movement trend to be inserted into the locking slots;

the locking assembly further comprises a locking housing rotationally connected with the locking plate, the locking housing is provided with a sliding slot for sliding insertion of the locking head, one end of the elastic element abuts against a bottom of the sliding slot, and a second end of the elastic element abuts against one end surface of the locking head;

the locking head comprises a connecting part, an abutting part integrally formed at one end of the connecting part, and a trigger part integrally formed at a second end of the connecting part; an avoidance slot is formed between the abutting part and the trigger part.

2. The weight-adjustable dumbbell according to claim 1, wherein a limiting part is provided on the outer peripheral surface of each of the two telescopic rods, a limiting hole is defined on the dumbbell plate, and the limiting part is configured to be inserted into the limiting hole.

3. A dumbbell assembly, comprising: one or more weight-adjustable dumbbells according to claim 1 and a dumbbell base, wherein a convex block is provided on the dumbbell base, the convex block abuts against the locking head, and the locking head is staggered with one of the locking slots.

* * * * *